US009709313B2

(12) United States Patent
Miki

(10) Patent No.: US 9,709,313 B2
(45) Date of Patent: Jul. 18, 2017

(54) ULTRA-LOW-TEMPERATURE DEVICE AND METHOD FOR REFRIGERATING OBJECT TO BE REFRIGERATED USING THE SAME

(71) Applicant: Kabushiki Kaisha Kobe Seiko Sho (Kobe Steel, Ltd.), Hyogo (JP)

(72) Inventor: Takashi Miki, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 251 days.

(21) Appl. No.: 14/760,050

(22) PCT Filed: Jan. 10, 2014

(86) PCT No.: PCT/JP2014/000089

§ 371 (c)(1),
(2) Date: Jul. 9, 2015

(87) PCT Pub. No.: WO2014/112343

PCT Pub. Date: Jul. 24, 2014

(65) Prior Publication Data

US 2015/0338151 A1 Nov. 26, 2015

(30) Foreign Application Priority Data

Jan. 15, 2013 (JP) ..... 2013-004339

(51) Int. Cl.
*F25D 3/10* (2006.01)
*F25B 9/10* (2006.01)
(Continued)

(52) U.S. Cl.
CPC ..... *F25D 3/10* (2013.01); *F25B 9/10* (2013.01); *F25B 9/14* (2013.01); *F25D 19/006* (2013.01); *F25B 2400/17* (2013.01); *H01F 6/04* (2013.01)

(58) Field of Classification Search
CPC .. F25D 3/10; F25D 19/006; F25B 9/14; F25B 9/10; F25B 2400/14
(Continued)

(56) References Cited

U.S. PATENT DOCUMENTS 4,689,970 A 9/1987 Ohguma et al.
4,827,736 A 5/1989 Miura et al.
(Continued)

FOREIGN PATENT DOCUMENTS

EP 1557624 A2 7/2005
JP S62-090910 A 4/1987
(Continued)

OTHER PUBLICATIONS

JP 3881675 B2 Translation.*
(Continued)

*Primary Examiner* — Frantz Jules
*Assistant Examiner* — Brian King
(74) *Attorney, Agent, or Firm* — Studebaker & Brackett PC

(57) ABSTRACT

Provided is an ultra-low-temperature device that enables the cold head of a refrigeration device to be coupled in a detachable manner so as to be capable of highly efficient heat transfer with respect to an object being cooled, while effectively suppressing the infiltration of heat into the object being cooled. This ultra-low-temperature device is equipped with: a cooled object container (16); a cold head insertion unit (18) having a cylindrical part (32) and a base part (34); a thermal coupling formation part (60) forming a thermal coupling part between the low-temperature end (28) of the cold head (26) and the base part (34); and a heat switch (70) provided between the base part (34) and the cooled object (12). The thermal coupling formation part (60) has refrigeration-device side recesses and protrusions (61, 62) and insertion-unit-side recesses and protrusions (63, 64), with the thermal coupling part being formed by the freezing of a gaseous heat transfer medium in the gaps (66) between these recesses and protrusions. The heat switch (70) has an insertion-unit-side heat switch element provided on the base part (34), and a cooled-body-side switch element, and the transfer of heat is enabled or prevented on the basis of whether the switch elements are in contact or are separated from each other.

14 Claims, 5 Drawing Sheets

(51) Int. Cl.
*F25D 19/00* (2006.01)
*F25B 9/14* (2006.01)
*H01F 6/04* (2006.01)

(58) Field of Classification Search
USPC ..... 62/51.1
See application file for complete search history.

(56) References Cited

U.S. PATENT DOCUMENTS

| | | | | |
|---|---|---|---|---|
| 5,842,348 | A | 12/1998 | Kaneko et al. | |
| 5,960,868 | A | 10/1999 | Kuriyama et al. | |
| 2007/0271933 | A1* | 11/2007 | Miki | C01B 3/0089 62/51.1 |
| 2012/0031110 | A1* | 2/2012 | Tanaka | F25D 19/006 62/51.1 |

FOREIGN PATENT DOCUMENTS

| | | | |
|---|---|---|---|
| JP | H01-139981 | A | 6/1989 |
| JP | H01-196479 | A | 8/1989 |
| JP | H08-128742 | A | 5/1996 |
| JP | H09-287838 | A | 11/1997 |
| JP | H10-238876 | A | 9/1998 |
| JP | 2005-055003 | A | 3/2005 |
| JP | 2005-210015 | A | 8/2005 |
| JP | 2005-331180 | A | 12/2005 |
| JP | 3881675 | B2 * | 2/2007 |

OTHER PUBLICATIONS

International Search Report; PCT/JP2014/000089; Apr. 15, 2014.
Written Opinion of the International Searching Authority; PCT/JP2014/000089; Apr. 15, 2014.

* cited by examiner

ULTRA-LOW-TEMPERATURE DEVICE AND METHOD FOR REFRIGERATING OBJECT TO BE REFRIGERATED USING THE SAME

TECHNICAL FIELD

The present invention relates to an ultra-low-temperature device for refrigerating an object to be refrigerated, such as a superconducting magnet, by using a refrigeration device, and to a method for refrigerating the object to be refrigerated by using the ultra low-temperature device.

BACKGROUND ART

Hitherto, as an ultra-low-temperature device for refrigerating an object to be refrigerated, such as a superconducting magnet or a liquid helium container that contains the superconducting magnet, an ultra-low-temperature device that uses a refrigeration device including a cold head has been known. In this ultra-low-temperature device, how efficiently the cold head is coupled to an object to be refrigerated (that is, bow small the thermal resistance can be made) and whether or not the cold head can be made separable from the object to be refrigerated are important subjects.

Patent Literature 1 discloses a device that uses a low-boiling gas, such as nitrogen, for coupling objects to be refrigerated and the cold head to each other. As shown in FIG. 6, this device includes a liquid helium container 100, a vacuum container 102 that contains the liquid helium container, a refrigeration device 106 that includes a cold head 104, a sleeve 108 that is formed between the liquid helium container 100 and the vacuum container 102 and into which the cold head 104 can be inserted from the outside of the vacuum container 102, a closing plate 110 that is mounted on a lower portion of the sleeve 108 so as to close the lower portion of the sleeve 108, a gas introducing pipe 112 for supplying heating gas, such as nitrogen gas, to a space directly above the closing plate 110, and heat transfer fins 114 that are secured to a lower surface of the closing plate 110. The closing plate 110 and the fins 114 are objects to be refrigerated by the refrigeration device 106. The refrigeration of the closing plate 110 and the fins 114 causes the temperature in the liquid helium container 100 to be maintained at an ultra-low temperature that is less than or equal to the boiling point of helium.

The cold head 104 includes a first refrigeration stage 104*a* at an intermediate portion of the cold head 104 and a second refrigeration stage 104*b* at a lower end portion of the cold head 104. The second refrigeration stage 104*b* and the liquid helium container 100, which is an object to be refrigerated, are coupled to each other so as to allow heat conduction as follows. First, liquid nitrogen is accumulated in a bottom portion of the sleeve 108. On the other hand, by immersing the second refrigeration stage 104*b* in the liquid nitrogen, the cold head 104 is inserted into the sleeve 108 at a location where a gap having a predetermined size is formed between a lower surface of the second refrigeration stage 104*b* and an upper surface of the closing plate 110. When, in this state, the cold head 104 is started, the second refrigeration stage 104*b* refrigerates the liquid nitrogen and solidifies it. This causes a thermal joint 116 formed of the solidified nitrogen to be formed. The thermal joint 116 has a high thermal conductivity, and efficiently transfers cold of the cold head 104 to the closing plate 110.

On the other hand, when, in order to, for example, maintain the refrigeration device 106, the cold head 104 is removed from the sleeve 108, the operation of the refrigeration device 106 is stopped, more desirably, heating gas (such as nitrogen gas) is introduced into the sleeve 108 via the gas introducing pipe 112. By this, the nitrogen of which the thermal joint 116 is formed is evaporated, as a result of which the thermal joint 116 disappears. This makes it possible to remove the cold head 104 from the inside of the sleeve 108.

In the device that is described in Patent Literature 1, it is difficult to prevent infiltration of heat into the objects to be refrigerated when removing the cold head 104. More specifically, in order to remove the cold head 104 from the sleeve 108, the temperature in the sleeve 108 needs to be increased to a temperature that is greater than or equal to the boiling point of nitrogen. Further, after removing the cold head 104, the inside of the sleeve 108 is open to the air. At this time, a large amount of heat infiltrates the inside of the liquid helium container 100 from the sleeve 108 via the closing plate 110.

CITATION LIST

Patent Literature

PTL 1: Japanese Unexamined Patent Application Publication No, 2005-210015

SUMMARY OF INVENTION

It is an object of the present invention to provide an ultra-low-temperature device that is used for refrigerating an object to be refrigerated by using a refrigeration device including a cold head and that enables the cold head to be coupled in a detachable manner so as to allow highly efficient heat transfer with respect to the object to be refrigerated while effectively suppressing the infiltration of heat into the object to be refrigerated; and a method for refrigerating an object to be refrigerated by using the ultra-low-temperature device.

An ultra-low-temperature device that the present invention provides includes a refrigeration-object container that includes an outside wall, the refrigeration-object container being provided for containing the object to be refrigerated at an inner side of the refrigeration-object container; a cold head insertion unit that extends from the outside wall towards the object to be refrigerated, the cold head insertion unit including a cylindrical part and a base part, the cylindrical part opening to an outside of the outside wall so as to allow the cold head to be inserted from a side of a low-temperature end of the cold head, the base part being coupled to the cylindrical part so as to cover a far-side end portion of the cylindrical part, the cold head insertion unit having a shape that allows an internal portion of the cold head insertion unit to be hermetically sealed by the inserted cold head; a thermal coupling formation part for forming a thermal coupling part between the low-temperature end of the cold head and the base part of the cold head insertion unit so as to allow conduction of heat therebetween; and a heat switch that is provided between the base part of the cold head insertion unit and the object to be refrigerated. The thermal coupling formation part includes refrigeration-device-side recesses and protrusions and insertion-unit-side recesses and protrusions, the refrigeration-device-side recesses and protrusions being provided at the low-temperature end of the cold head and rising and falling in a direction that is parallel to a direction of insertion of the cold head, the insertion-unit-side recesses and protrusions being provided at a surface of the base part of the cold head insertion unit that faces the side of the low-temperature end of the cold head and rising and falling in the direction that is parallel to the direction of insertion of the cold head so as to be capable of opposing the refrigeration-device-side recesses and protrusions at a gap. The refrigeration-device-side recesses and protrusions and the insertion-unit-side recesses and protrusions having a form that forms the thermal coupling part by solidifying a heat conduction medium in a gaseous state at an operation temperature of the low-temperature end of the cold head in the gap between the refrigeration-device-side recesses and protrusions and the insertion-unit-side recesses and protrusions. The heat switch includes an insertion-unit-side heat switch element and a refrigeration-object-side heat switch element, the insertion-unit-side heat switch element being provided at a refrigeration-object-side surface of the base part, which is a surface of the base part that faces the object to be refrigerated, the refrigeration-object-side heat switch element being disposed at the object to be refrigerated so as to oppose the insertion-unit-side heat switch element in the direction that is parallel to the direction of insertion of the cold head. The heat switch is switched between an on state and an off state, the on state being a state in which the conduction of heat is allowed between the base part of the cold head insertion unit and the object to be refrigerated when the switch elements contact each other as a result of the switch elements being displaced relative to each other in the direction that is parallel to the direction of insertion of the cold head, the off state being a state in which the conduction of heat is blocked between the base part of the cold head insertion unit and the object to be refrigerated when the switch elements are separated from each other as a result of the switch elements being displaced relative to each other in the direction that is parallel to the direction of insertion of the cold head.

The present invention provides a method for refrigerating the object to be refrigerated by using the ultra-low-temperature device. The method includes providing the ultra-low-temperature device; inserting the cold head of the refrigeration device into the cold head insertion unit of the ultra-low-temperature device from the side of the low-temperature end of the cold head of the refrigeration device to hermetically seal an inside of the cold head insertion unit and to cause the refrigeration-device-side recesses and protrusions, provided at the low-temperature end of the cold head, and the insertion-unit-side recesses and protrusions to oppose each other at the gap; forming the thermal coupling part by solidifying the heat conduction medium in the gaseous state in the gap by operating the refrigeration device; and turning on the heat switch.

DESCRIPTION OF EMBODIMENTS

An embodiment of the present invention is described with reference to the drawings. An ultra-low-temperature device according to the embodiment is a superconducting magnet device, and includes, as objects to be refrigerated, a superconducting magnet 10 and a liquid helium container 12 that contains the superconducting magnet 10. The superconducting magnet 10 and the liquid helium container 12 are refrigerated by a refrigeration device 20. However, the present invention is not limited to these types of objects to be refrigerated. The present invention is applicable to refrigeration of a SQUID magnetometer and other superconducting elements.

Figure 1:
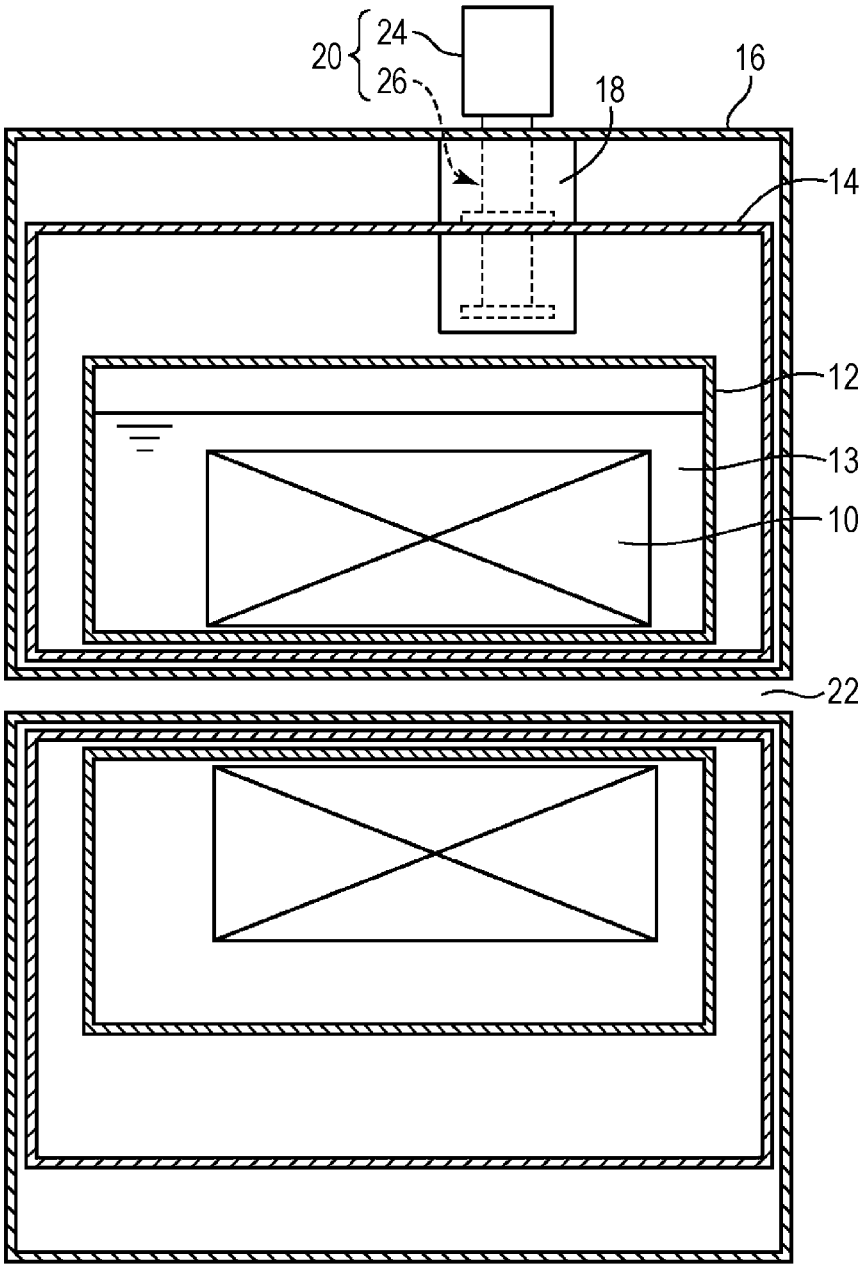
FIG. 1 is a sectional front view of an ultra-low-temperature device according to an embodiment of the present invention.

In addition to the superconducting magnet 10 and the liquid helium container 12, the device shown in FIG. 1 includes a heat shield container 14 that contains the liquid helium container 12, a vacuum container 16 that contains the heat shield container 14 and whose interior is in a vacuous state, and a cold head insertion unit 18.

A common horizontal center axis extends through the superconducting magnet 10 and the containers 12, 14, and 16. The superconducting magnet 10 and the containers 12, 14, and 16 are each formed in the shape of a doughnut surrounding a sample space 22 extending along the center axis. The liquid helium container 12 contains liquid helium 13 for refrigerating the superconducting magnet 10. The superconducting magnet 10 is immersed in the liquid helium 13. The heat shield container 14 and the vacuum container 16 according to the embodiment each form a refrigeration object container that contains the superconducting magnet 10 and the liquid helium container 12, serving as objects to be refrigerated.

Figure 2:
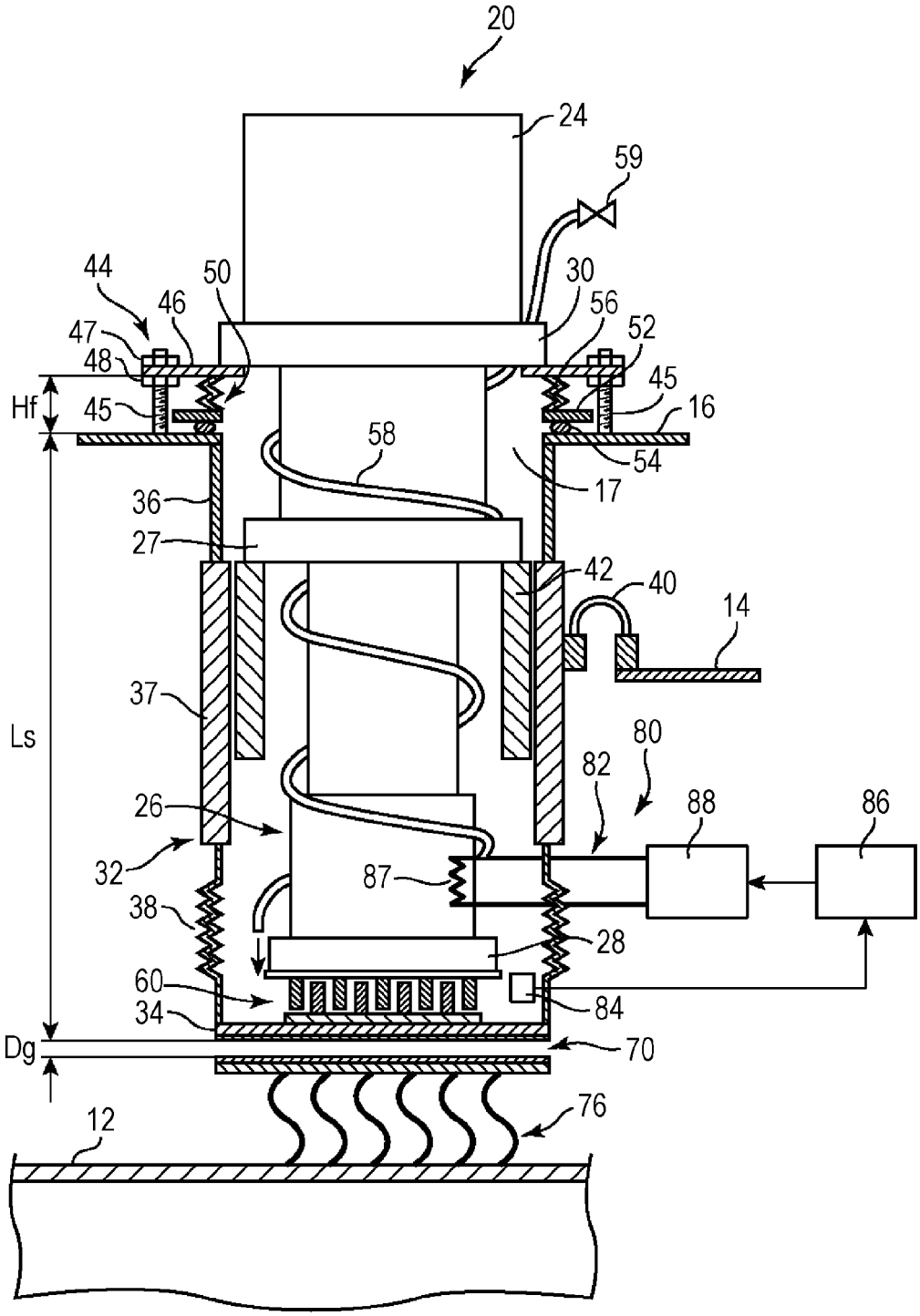
FIG. 2 is a sectional front view of a main portion of the ultra-low-temperature device.

As shown in FIG. 2, the refrigeration device 20 according to the embodiment is a two-stage GM refrigeration device. More specifically, the refrigeration device 20 includes a refrigeration-device body 24 and a cold head 26 that is coupled to the refrigeration-device body 24. The overall shape of the cold head 26 is a substantially columnar shape. The cold head 26 includes an intermediate portion and an end portion. The intermediate portion forms a first refrigeration stage 27. The end portion, that is a low-temperature end, forms a second refrigeration stage 28 whose set temperature is lower than that of the first refrigeration stage 27. The first refrigeration stage 27 is designed so as to refrigerate the heat shield container 14 to a predetermined first target temperature (such as 40 K). The second refrigeration stage 28 is designed so as to refrigerate the liquid helium container 13 to a second target temperature (such as 4 K or lower) that is lower than the first target temperature.

In the embodiment, a flange 30 is provided between the refrigeration-device body 24 and the cold head 26 so as to have an outside diameter that is larger than those of the refrigeration-device body 24 and the cold head 26. The outside diameter of the stage 27 and the outside diameter of the stage 28 are larger than the outside diameters of the other portions. However, the outside diameter of the first refrigeration stage 27 is smaller than the outside diameter of the flange 30, and the outside diameter of the second refrigeration stage 28 is smaller than the outside diameter of the first refrigeration stage 27.

In the present invention, specific shapes and structures of the refrigeration device that is used are not particularly limited to certain shapes and structures. For example, a single stage refrigeration device (such as one including only the second refrigeration stage 28) may be used.

Figure 3:
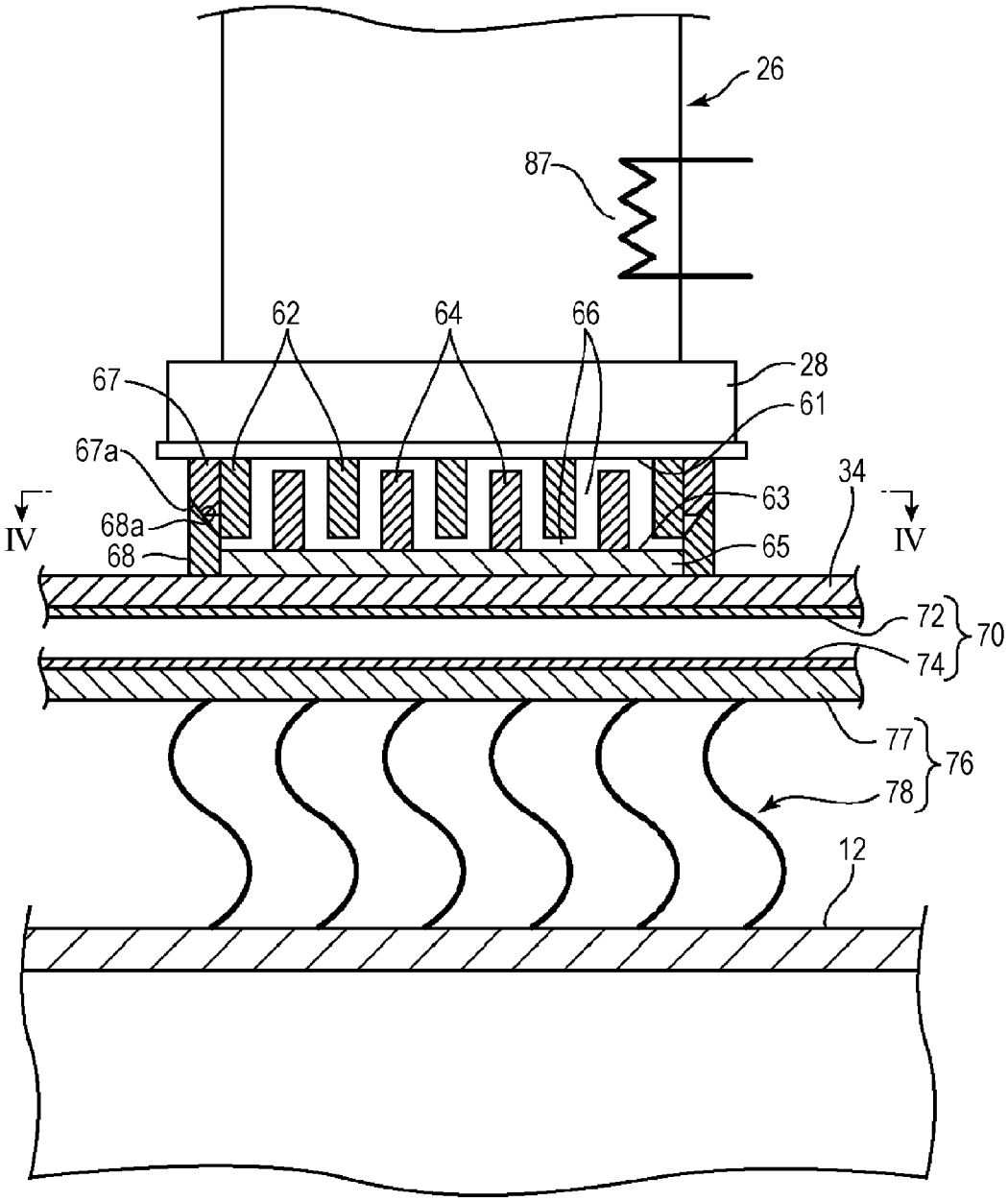
FIG. 3 is an enlarged sectional view of a structure of a heat switch shown in FIG. 2 and a structure of the vicinity of the heat switch.

The cold head insertion unit 18 is provided in a region extending from an outside wall (a top wall in the embodiment) of the vacuum container 16 to the vicinity of the liquid helium container 12 serving as an object to be refrigerated. The cold head 26 is insertable in the cold head insertion unit 18. The cold head insertion unit 18 includes a cylindrical part 32 and a base part 34 as shown in FIGS. 2 and 3. The cylindrical part 32 extends downward from the top wall of the vacuum container 16 towards the liquid helium container 12. The cylindrical part 32 has a cylindrical shape that opens to the outside of the top wall (in an upward direction in the embodiment) so as to allow the cold head 18 to be inserted downward in the cylindrical part 32 from a side of the second refrigeration stage 28, which corresponds to the low-temperature-end, of the cold head 18. The base part 34 is disk-shaped in the embodiment, and is coupled to the cylindrical part 32 so as to cover a far-side end portion (lower end portion in the embodiment) of the cylindrical part 32.

The cylindrical part 32 has a structure that allows it to be resiliently stretched and contracted in directions (up-down directions in the embodiment) that are parallel to the direction of insertion of the cold head. By the stretching and contraction of the cylindrical part 32, the base part 34 can be displaced in the up-down directions.

More specifically, the cylindrical part 32 includes a straight pipe unit 36, a heat shield coupling sleeve 37, and a bellows unit 38. The bellows unit 38 is capable of being stretched and contracted in the up-down directions. An upper end of the straight pipe unit 36 is joined to a peripheral edge portion at an opening 17 of the vacuum container 16, and a lower end of the bellows unit 38 is joined to a peripheral edge portion of the base part 34. The heat shield coupling sleeve 37 is provided between the straight pipe unit 36 and the bellows unit 38, and is coupled to a heat conduction member 40 via the heat shield container 14.

A heat transfer sleeve 42 is coupled to a lower end surface of a peripheral edge of the first refrigeration stage 27 of the cold head 26. The heat transfer sleeve 42 is disposed so as to surround the cold head 26, and is provided with a plurality of flexing portions (not shown) along an outer peripheral surface thereof, with the plurality of flexing portions being flexible in a radial direction. Then, while the flexing portions are flexed as the cold head 26 is being inserted into the cold head insertion unit 18, they press-contact an inner peripheral surface of the heat shield coupling sleeve 37, so that cold of the first refrigeration stage 27 is transferred to the heat shield container 14 via the heat transfer sleeve 42, the heat shield coupling sleeve 37, and the heat conduction member 40.

With the cold head 26 being inserted in the cold head insertion unit 18, the flange 30 at the refrigeration device 20 is supported by the top wall of the vacuum container 18 with a height adjusting mechanism 44 being disposed therebetween. This makes it possible to hermetically seal the inside of the cold head insertion unit 18.

The height adjusting mechanism 44 includes a plurality of screw shafts 45 that are provided in a standing manner around the opening 17 at the top wall of the vacuum container 18; a height adjusting flange 46 that is joined to a lower surface of a peripheral edge portion of the flange 30, that has through holes allowing the screw shafts 45 to be inserted therein, and that has the shape of a doughnut plate; an upper nut 47 and a lower nut 48 that are screwed onto each of the screw shafts 45; and a sealing unit 50. By placing the height adjusting flange 46 on the lower nuts 48 among the nuts 47 and 48 and tightening the upper nuts 47 from above the height adjusting flange 46, the flange 30 is supported on the top wall of the vacuum container 16.

The sealing unit 50 includes a sealing-material holding plate 52 having the shape of a doughnut plate, a sealing material 54 that includes an O ring or the like and that is secured to a lower surface of the sealing-material holding plate 52, and a cylindrical bellows unit 56 that couples the sealing-material holding plate 52 and a lower surface of the height adjusting flange 46 to each other. In the sealing unit 50, while the bellows unit 56 is resiliently compressed, the sealing material 54 is pushed against a top surface of the top wall of the vacuum container 16 (top surface of the peripheral edge portion of the opening 17). This makes it possible for the refrigeration device 20 to hermetically seal the inside of the cold head insertion unit 18.

Therefore, according to the height adjusting mechanism 44, by adjusting the positions of the nuts 47 and 48 relative to the screw shafts 45, it is possible to adjust a height Hf (FIG. 2) of the height adjusting flange 46 from the top surface of the vacuum container 16 when the cold head 26 is completely inserted in the cold head insertion unit 18, that is, to adjust the depth of insertion of the cold head 26 with respect to the cold head insertion unit 18.

As shown in FIG. 2, the ultra-low-temperature device further includes a gas supply and exhaust pipe 58, a thermal coupling formation part 60, a heat switch 70, and a temperature controlling device 80.

The thermal coupling formation part 60 forms a thermal coupling part between the second refrigeration stage 28, which is the low-temperature end, of the cold head 26 and the base part 34 of the cold head insertion unit 18. The thermal coupling formation part 60 includes refrigeration-device-side recesses and protrusions, which are provided at the second refrigeration stage 28, and insertion-unit-side recesses and protrusions, which are provided at the base part 34. These recesses and protrusions rise and fall in directions that are parallel to the direction of insertion of the cold head 26 so as to be capable of opposing each other with gaps therebetween. The recesses and protrusions have a form that forms the thermal coupling part by solidifying a heat conduction medium described below in the gaps.

Figure 4:
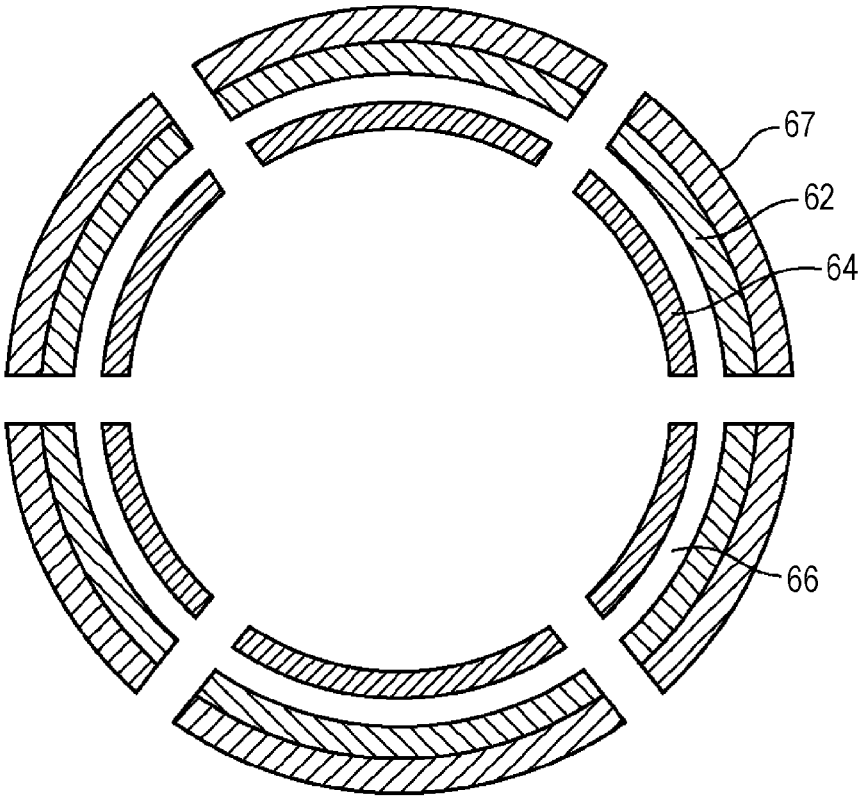
FIG. 4 is a sectional view taken along line IV-IV in FIG. 3.

As shown in FIG. 3, the refrigeration-device-side recesses and protrusions according to the embodiment include a refrigeration-device-side base surface 61 that opposes the insertion-unit-side recesses and protrusions and a plurality of refrigeration-device-side fins 62 that protrude downward from the refrigeration-device-side base surface 61. In the embodiment, the refrigeration-device-side base surface 61 is formed of a lower surface of the second refrigeration stage 28. The refrigeration-device-side fins 62 each have an arcuate shape having a common center that corresponds to the center of the second refrigeration stage 28, and are arranged apart from each other in a radial direction of the second refrigeration stage 28. Further, in this embodiment, in order to allow infiltration of the heat conduction medium described below to the inner sides of the refrigeration-device-side fins 62, as shown in FIG. 4, there are breaks in the refrigeration-device-side fins 62 in a peripheral direction. In FIG. 4, for convenience, only the outermost refrigeration-device-side fin 62 is shown.

Similarly, the insertion-unit-side recesses and protrusions according to the embodiment include an insertion-unit-side base surface 63 that opposes the refrigeration-device-side recesses and protrusions and a plurality of insertion-unit-side fins 64 that protrude upward from the insertion-unit-side base surface 63. In the embodiment, the insertion-unit-side base surface 63 is formed of an upper surface of a plate 65 that is disposed on the base part 34. However, the insertion-unit-side base surface 63 may be formed of an upper surface of the base part 34 itself. As with the refrigeration-device-side fins 62, the insertion-unit-side fins 64 each have an arcuate shape having a common center that corresponds to the center of the second refrigeration stage 28, and are arranged apart from each other in a radial direction of the second refrigeration stage 28. Further, in order to allow infiltration of the heat conduction medium described below to the inner sides of the insertion-unit-side fins 62, as shown in FIG. 4 there are breaks in the insertion-unit-side fins 64 in a peripheral direction.

Regarding the relationship between the position of each refrigeration-device-side fin 62 and the position of each insertion-unit-side fin 64 relative to each other, with the cold head 26 being inserted in the cold head insertion unit 18, as shown in FIGS. 3 and 4, the fins 62 and 64 are disposed such that each insertion-unit-side fin 64 protrudes from between corresponding refrigeration-device-side fins 62 that are adjacent to each other in a radial direction and such that gaps 66 are formed between the refrigeration-device-side fins 62 and the insertion-unit-side fins 64 in both a radial direction and the direction of insertion of the cold head 26.

The ultra-low-temperature device further includes a refrigeration-device-side positioning unit 67 and an insertion-unit-side positioning unit 68. The positioning units 67 and 68 position the fins 62 and the fins 64 relative to each other such that the gaps 66 are reliably formed.

As with the fins 62 and 64, the refrigeration-device-side positioning unit 67 has an arcuate shape whose center corresponds with the center of the second refrigeration stage 28 and is fin-shaped, and has breaks in a peripheral direction thereof. At a position that is outward of the outermost refrigeration-device-side fin 62, the refrigeration-device-side positioning unit 67 protrudes downward from the refrigeration-device-side base surface 61 as with the refrigeration-device-side fins 62. A lower surface of the refrigeration-device-side positioning unit 67 forms a contact surface 67*a*, which is a tapering surface that tapers towards the base part 34 (lower side in FIGS. 3 and 4) as it extends towards an inner side in a radial direction.

On the other hand, as with the fins 62 and 64, the insertion-unit-side positioning unit 68 also has an arcuate shape whose center corresponds with the center of the second refrigeration stage 28 and is fin-shaped, and has breaks in a peripheral direction thereof. At a position that is outward of the outermost insertion-unit-side fin 64, the insertion-unit-side positioning unit 68 protrudes upward from the upper surface of the base part 34 as with the insertion-unit-side fins 64. A upper surface of the insertion-unit-side positioning unit 68 forms a contact surface 68*a*, which is a tapering surface that tapers towards the base part 34 (lower side in FIGS. 3 and 4) as it extends towards the inner side in a radial direction.

The positions of both of the positioning units 67 and 68 relative to each other and the shapes of the contact surfaces 67*a* and 68*a* are set such that, by inserting the cold head 26 into the cold head insertion unit 18, the contact surfaces 67*a* and 68*a* contact each other, and such that, by the contact, an inserting operation force that is applied to the cold head 26 is transmitted to the base part 34 of the cold head insertion unit 18 and the fins 62 and 64 are positioned relative to each other for providing the gaps 66 between the refrigeration-device-side fins 62 and the insertion-unit-side fine 64 in a radial direction and the direction of insertion of the cold head. That is, both of the positioning units 67 and 68 function as operation force transmitting units and positioning units.

With the cold head 26 being inserted in the cold head insertion unit 18, the gas supply and exhaust pipe 58 is installed such that air in the cold head insertion unit 18 is led out and a heat conduction medium is introduced. The gas supply and exhaust pipe 58 according to the embodiment is wound around the cold head 26 so as to be mounted and removed together with the cold head 26. The gas supply and exhaust pipe 58 includes an inlet end and an outlet end, a gas supply pump and a vacuum pump (not shown) being switchably coupled to the inlet end via a valve 59 shown in FIG. 2 and the outlet end being disposed at a region near the thermal coupling formation part 60.

Figure 5:
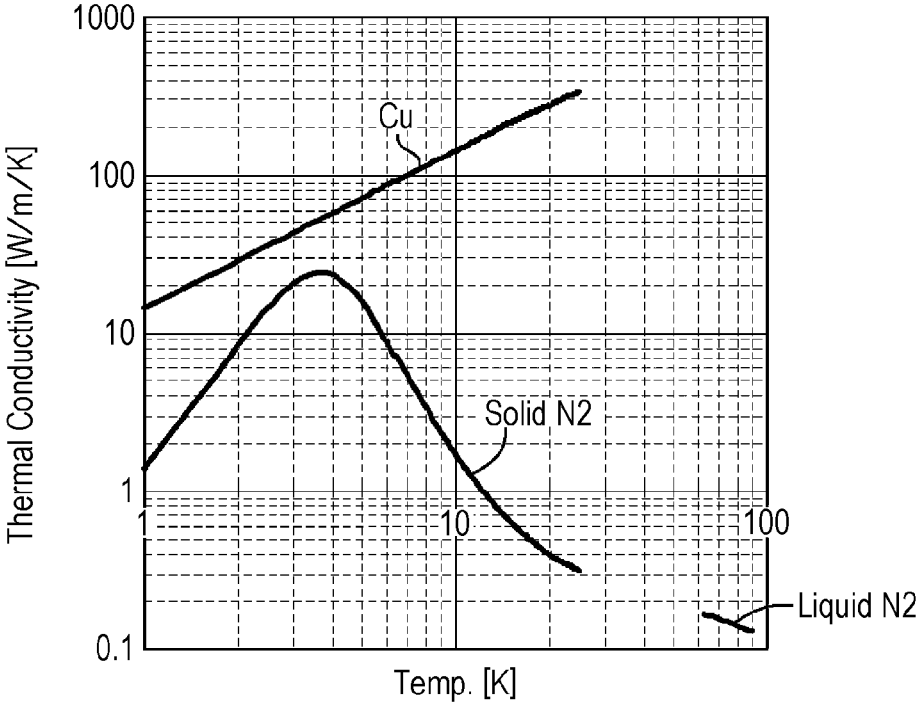
FIG. 5 is a graph of thermal conductivities of solid nitrogen, liquid nitrogen, and copper.
Figure 6:
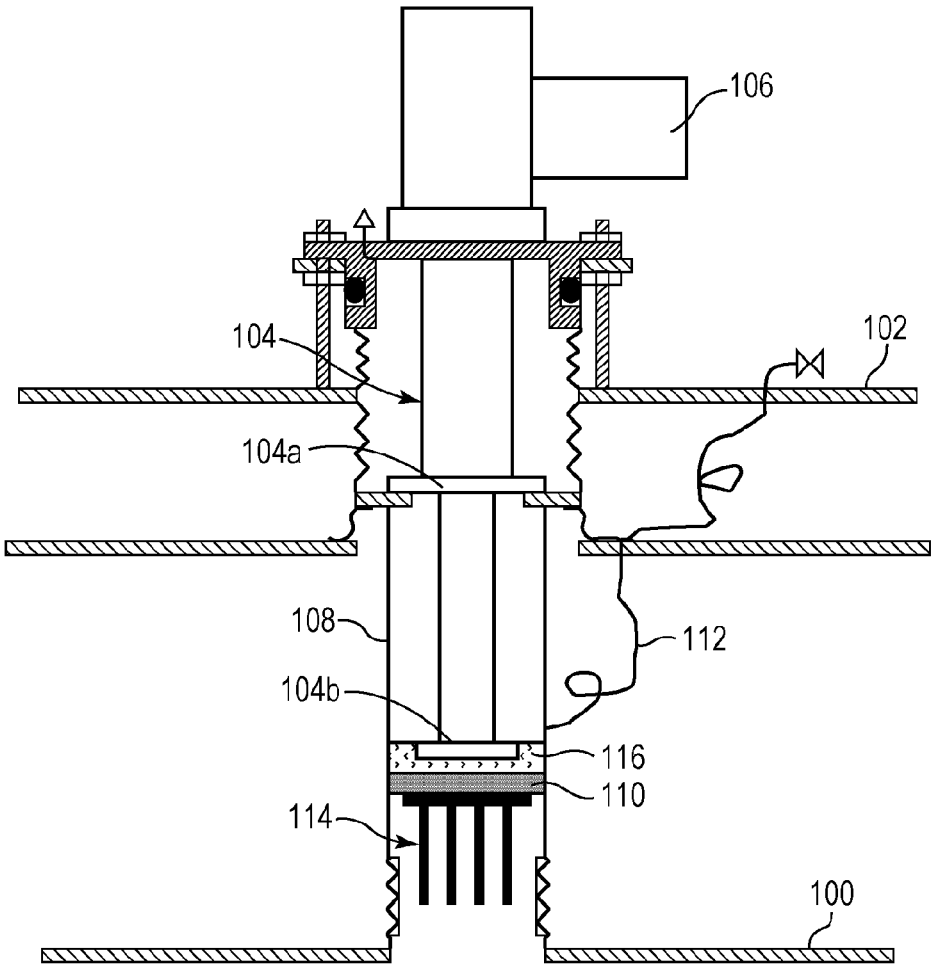
FIG. 6 is a sectional front view of a main portion of an existing ultra-low-temperature device.

The heat conduction medium that is introduced into the cold head insertion unit 18 is kept in a gas phase at ordinary temperature, whereas the heat conduction medium is solidified at an operation temperature (such as 4K or lower) of the second refrigeration stage 28, which is the low-temperature end, of the cold head 26 to be used for forming the thermal coupling part that couples the second refrigeration stage 28 and the base part 34 of the cold head insertion unit 18 to each other so as to allow heat conduction therebetween. Therefore, the heat conduction medium is one having high thermal conductivity (low thermal resistance) when it is at a low temperature in a solidified state. Desirably, the heat conduction medium is specifically nitrogen. As shown in FIG. 5, the thermal conductivity of solidified nitrogen (solid nitrogen) reaches a peak at a region near the operation temperature of the second refrigeration stage 28 (region of 3 to 4 K) such that, at, for example, 3.8 K, nitrogen can have a thermal conductivity of 24.1 W/m/K. This thermal conductivity is comparable to the thermal conductivity of copper having low purity, such as phosphorous-deoxidized copper, and allows good thermal coupling. Substances other than nitrogen, such as neon, parahydrogen, or helium may be used as appropriate as the heat conduction medium.

The heat switch 70 is provided between the base part 34 of the cold head insertion unit 18 and the liquid helium container 12, serving as an object to be refrigerated, and is used for switching between an on state in which heat conduction is performed therebetween and an off state in which the heat conduction is blocked. In the embodiment, the heat switch 70 includes an insertion-unit-side metallic plate 72, serving as an insertion-unit-side heat switch element, and a refrigeration-object-side metallic plate 74, serving as a refrigeration-object-side heat switch element.

The insertion-unit-side metallic plate 72 is provided so as to cover a refrigeration-object-side surface (lower surface in FIG. 3) of the base part 34 that faces the object to be refrigerated. The refrigeration-object-side metallic plate 74 is disposed at the object to be refrigerated so as to oppose the insertion-unit-side metallic plate 72 in a direction (up-down direction in FIG. 3) that is parallel to the direction of insertion of the cold head 26.

Although the refrigeration-object-side metallic plate 74 may be, for example, directly disposed on an upper surface of the liquid helium container 12, in the embodiment, the refrigeration-object-side metallic plate 74 is supported by the liquid helium container 12 with a supporting member 76 being disposed therebetween. The supporting member 76 includes a supporting plate 77 and a braid 78. The braid 78 is interposed between the supporting plate 77 and a top wall of the liquid helium container 12. The braid 78 includes, for example, braided wires formed of copper. While allowing heat conduction between the supporting plate 77 and the liquid helium container 12, the braid 78 supports the supporting plate 77 in an orientation that is parallel to the liquid helium container 12. Further, resilient deformation of the braid 78, itself, allows the supporting plate 77 to be slightly displaced in the up-down directions. By resilient force thereof, the braid 78 has the function of increasing the degree of contact between the metallic plates 72 and 74 with each other by increasing contact pressure between the metallic plates 72 and 74 as described below, and suppresses transmission of vibration of the vibration device 20 to the liquid helium container 12. The refrigeration-object-side metallic plate 74 is disposed on an upper surface of the supporting plate 77 so as to oppose the insertion-unit-side metallic plate 72 in a direction (up-down direction) that is parallel to the direction of insertion of the cold head 26.

The metallic plates 72 and 74 are both formed of materials having excellent conductivity and allowing excellent contact therebetween. With the metallic plates 72 and 74 being in close contact with each other, heat is properly conducted between the metallic plates 72 and 74. More specifically, as the metallic plates 72 and 74, it is desirable to use ones in which surfaces of base materials formed of copper plates are, for example, electrolytically polished and the electrolytically polished surfaces are silver plated or gold-plated. However, the heat switch elements according to the present invention are not limited to those that are formed of members, like the metallic plates 72 and 74, which are provided separately from the base part 34 and the object to be refrigerated. For example, it is possible to form the insertion-unit-side heat switch element out of the base part 34, itself, and to, similarly, form the refrigeration-object-side heat switch element out of, for example, an outside wall, itself, of the liquid helium container 12.

A natural length Ls of the cylindrical part 32 of the cold head insertion unit 18 shown in FIG. 2, that is, the length of the cylindrical part 32 when an external force (inserting operation force of the cold head 26) is not applied to the cold head insertion unit 18 is set such that the insertion-unit-side metallic plate 72, which is provided at the lower surface of the base part 34 that is coupled to the cylindrical part 32, is separated from the refrigeration-object-side metallic plate 74 by a distance Dg (FIG. 2) at an upper side from the plate 74. Although, for the sake of convenience, FIG. 2 is drawn such that a gap having a size corresponding to the distance Dg is formed between the metallic plates 72 and 74, actually, a height Hf of the flange 30 and an insertion depth of the cold head 26 are adjusted by the height adjusting mechanism 44 such that a downward inserting operation force that is transmitted to the base part 34 of the cold head insertion unit 18 from the cold head 26 via the positioning units 67 and 68 stretches the bellows unit 38 of the cylindrical part 32 and displaces the base part 34 and the insertion-unit-side metallic plate 72 downward to closely contact the insertion-unit-side metallic plate 72 with the refrigeration-object-side metallic plate 74.

As shown in FIG. 2, the temperature controlling device 80 performs control for maintaining the temperature of the thermal coupling formation part 60 at a target temperature during the operation of the cold head 26 inserted in the cold head insertion unit 26. The target temperature is set at a temperature for maintaining the heat conduction medium in a liquid phase. For example, when the heat conduction medium is nitrogen gas, the target temperature is desirably set to a temperature that is slightly higher than its triple point (64 K or temperatures near 64 K).

More specifically, the temperature controlling device 80 includes a heater 82, a temperature sensor 84, and a temperature regulator 86. The heater 82 includes a coil 87, which is provided near the thermal coupling formation part 60 (a portion near the second refrigeration stage 28 of the cold head 26 in FIGS. 2 and 3) and a body 88 that heats the coil 87 by causing electric current to flow through the coil 87. The temperature sensor 84 is provided at a location near the thermal coupling formation part 60 and outputs an electric signal corresponding to the temperature at this location. The temperature regulator 86 controls the operation of the heater 82 such that the temperature corresponding to the electric signal that is output from the temperature sensor 84 is set closer to the target temperature that has been previously set. Although the coil 87 and the temperature sensor 84 may be previously installed in the cold head insertion unit 18, the coil 87 and the temperature sensor 84 may be mounted on the cold head 26 such that they are inserted into and removed from the cold head insertion unit 18 together with the cold head 26. In this case, the coil 87 and wires that are coupled to the temperature sensor 84 may be wound around the cold head 26 similarly to the gas supply and exhaust pipe 58.

Further, although not shown, it is desirable that the cold head 26 or the cold head insertion unit 18 be provided with a pressure sensor that detects the pressure in the cold head insertion unit 18 in which the cold head 26 has been inserted. As described below, the pressure sensor makes it possible to know that the heat conduction medium enclosed in the cold head insertion unit 18 has been liquefied (or solidified) at the outside of the cold head insertion unit 18.

Next, a method for refrigerating the objects to be refrigerated (superconducting magnet 10 and liquid helium container 12) by using the ultra-low-temperature device and the refrigeration device 20 and a method for attaching and detaching the refrigeration device 20 are described.

1) Initial State

In an initial state, that is, in a state in which the cold head 26 of the refrigeration device 20 is not inserted in the cold head insertion unit 18, the length of the cylindrical part 32 of the cold head insertion unit 18 is kept at the natural length Ls, and the insertion-unit-side metallic plate 72, which is provided at the lower surface of the base part 34 that is coupled to the cylindrical part 32, is separated from the refrigeration-object-side metallic plate 74 at the upper side from the plate 74.

2) Insertion of Cold Head 26 (FIG. 2)

From the initial state, the cold head 26 is inserted downward into the cold head insertion unit 28 starting with the second refrigeration stage 28. As mentioned above, the gas supply and exhaust pipe 58, the heat transfer sleeve 42, the height adjusting flange 46, the sealing unit 50, the plurality of refrigeration-device-side fins 62 that form the thermal coupling formation part 60, and the refrigeration-device-side positioning unit 67 are previously provided at the cold head 26; and are inserted into the cold head insertion unit 18 together with the cold head 26.

When inserting the cold head 26, the plurality of flexing portions that are provided along the outer peripheral surface of the heat transfer sleeve 42 press-contact the inner peripheral surface of the heat shield coupling sleeve 37 that form the cylindrical part 32 of the cold head insertion unit 18. Further, as shown in FIG. 3, when the tapering contact surface 67*a*, which corresponds to the lower surface of the refrigeration-device-side positioning unit 67, contacts the similarly tapering contact surface 68*a*, which corresponds to the upper surface of the insertion-unit-side positioning unit 68, the second refrigeration sleeve 28 of the cold head 26 and the base part 34 of the cold head insertion unit 18 are positioned relative to each other, that is, centering thereof is performed. Accordingly, the gaps 66 having previously prescribed sizes are formed between the refrigeration-device-side fins 62 and the insertion-unit-side fins 64 in both the radial direction and the direction of insertion of the cold head 26.

On the other hand, in the height adjusting mechanism 44, with only the lower nuts 48 being previously fitted on the screw shafts 45, the screw shafts 45 are inserted into the plurality of through holes in the height adjusting flange 46 secured to the flange 30 of the refrigeration device 20, and the cold head 26 is inserted, that is, the entire refrigeration device 20 is lowered. These operations end when the height adjusting flange 46 is placed on the lower nuts 48. At this time, as mentioned above, the contact surface 67*a* of the positioning unit 67 and the contact surface 68*a* of the positioning unit 68 contact each other, and the sealing material 54 of the sealing unit 40, which is provided at the height adjusting flange 46, is in close contact with the entire peripheral edge portion at the opening 17 of the vacuum container 12, so that the inside of the cold head insertion unit 18 is hermetically sealed.

3) Replacement of Gas in Cold Head Insertion Unit 18

Replacement of gas in the cold head insertion unit 18 with respect to the insertion unit 18 that has been hermetically sealed as described above, more specifically, leading out of air from the insertion unit 18 and introduction of a heat conduction medium (such as nitrogen gas) into the insertion unit 18 are performed by using the gas supply and exhaust pipe 58 and the valve 59. In this way, the cold head insertion unit 18 is filled with the gas formed of the heat conduction medium.

4) Operation of Refrigeration Device 20 and Temperature Controlling Device 80

After the gas has been replaced, the refrigeration device 20 and the temperature controlling device 80 are started. By operating the refrigeration device 20, the temperature surrounding the second refrigeration stage 28 starts to drop. However, the coil 87 is heated by the operation of the temperature controlling device 80, so that the second refrigeration stage temperature is finally controlled to a temperature near a first target temperature (such as a temperature that is slightly higher than the triple point of the heat conduction medium). By the procedure (3), the pressure of the gas forming the heat conduction medium enclosed in the insertion unit 18 is reduced, so that heat conduction medium is liquefied while the temperature surrounding the second refrigeration stage is maintained at the first target temperature, and the liquefied gas is accumulated at the bottom of the insertion unit 18.

5) Stoppage of Temperature Controlling Device 80

As the heat conduction medium is liquefied, the pressure in the cold head insertion unit 18 is reduced, and the pressure is stabilized at a minimum value when the liquefaction is completed (for example, the pressure is at a saturation pressure near the triple point of nitrogen, and a substantially vacuous state is provided). Accordingly, the temperature regulator 86 of the temperature controlling device 80 monitors an output signal from the pressure sensor (not shown), and, when the output signal becomes a value that is less than a preset value, stops the driving of the heater 82 on the basis of the determination that the liquefaction has been completed. As a result, refrigeration of the first refrigeration stage 27 and refrigeration of the second refrigeration stage 28 progress again, so that the temperature of the liquid (liquefied head conduction medium) with which the gaps 66 between the fins 62 and 64 is filled is gradually reduced, and the liquid is finally solidified.

The thermal coupling part that has been formed by solidifying the heat conduction medium in this way has excellent thermal conductivity (for example, in the case of nitrogen, the thermal conductivity is 24.2 W/m/K at 3.8 K). For example, when the size of the gaps 66 between the fins 62 and 64 is 0.1 mm and the total surface area of surfaces of the fins 62 and 64 that oppose each other in a radial direction or the direction of insertion of the cold head is $1.6\times10^4$ mm$^2$, in the case of nitrogen, the thermal resistance at the thermal coupling part that is formed is only $2.6\times10^{-4}$ mK/W. That is, when the amount of heat that moves is 1 W, the interface temperature difference is only 0.26 mK. In contrast, when the heat conduction medium is liquid helium, since the thermal conductivity thereof is $2.48\times10^{-2}$ W/m/K at 3.8 K, the thermal resistance is a very high value of 0.25 K/W.

This solidified substance (such as solid nitrogen) allows, along with the fins 62 and 64, the cold of the second refrigeration stage 28 to be transferred with high efficiency to the base part 34 of the cold head insertion unit 18.

6) Further Insertion of Cold Head 26

After forming the heat conduction medium that has been solidified at the base part of the cold head insertion unit 18 by the procedure (5), the cold head 18 is further inserted downward. More specifically, after loosening the upper nuts 47 and the lower nuts 48 once at the height adjusting mechanism 44 and placing the height adjusting flange 46 in a state in which it is movable in the up-down directions, the cold head 26 is further pushed downward.

When the insertion of the cold head 26 progresses and the inserting operation force is transmitted to the base part 34 of the cold head insertion unit 18 via the positioning units 67 and 68, the base part 34 is displaced downward due to resilient deformation in a stretching direction of the bellows unit 38 of the cylindrical part 32 of the cold head insertion unit 18, so that the insertion-unit-side metallic plate 72, which is provided at the lower surface of the base part 34, comes into close contact with the refrigeration-object-side metallic plate 74. That is, the state of the heat switch 70 is switched from an off state to an on state, so that heat can be conducted between the base part 34 of the cold head insertion unit 18 and the liquid helium container 12, which is an object to be refrigerated.

In this way, after the base part 34 has been lowered until the metallic plates 72 and 74 are in close contact with each other, the upper nuts 47 and the lower nuts 48 are at the heights where they are tightened again, as a result of which the securing of the refrigeration device 20 to the vacuum container 16 is completed.

7) Detaching of Cold Head 26

Next, in order to attach and detach the cold head 26 of the refrigeration device 20 from the cold bead insertion unit 18 for the purpose of, for example, maintaining the refrigeration device 20, the heat switch 70 may be set in the off state to evaporate the heat conduction medium. More specifically, by removing the upper nuts 48 of the height adjusting mechanism 44 and slightly raising the refrigeration device 20, the metallic plates 72 and 74 of the heat switch 70 may be separated from each other to stop the operation of the refrigeration device 20. Further, by driving the heater 82 or supplying ordinary-temperature gas into the cold head insertion unit 18 through the gas supply and exhaust pipe 58, it is possible to accelerate the rise in temperature and evaporation of the heat conduction medium.

When the heat conduction medium is evaporated in this way, the fins 62 and 64 of the thermal coupling formation part 60 are disconnected from each other. This makes it possible to easily remove the cold head 26 from the cold head insertion unit 18. In addition, the heat switch 70 in the off state effectively prevents the infiltration of heat to the object to be refrigerated (liquid helium container 12) occurring when the temperature of the cold head insertion unit 18 rises. When, for example, the area of each of the metallic plates 72 and 74 of the heat switch 70 is $1.6\times10^2$ $m^2$, and the emissivity of the surfaces thereof is 0.01, the radiative heat transfer amount between the metallic plates 72 and 74 is kept small at 36 mW even if the temperature of the base part 34 rises to ordinary temperature. Therefore, the temperature rise of the object to be refrigerated when the refrigeration device 20 is being repaired or replaced is effective suppressed.

At this time, the capacity of the cold head insertion unit 18 may be set such that, at a pressure that is close to a pressure approximately equal to atmospheric pressure, the cold head insertion unit 18 is filled with the heat conduction medium that has been evaporated from the solidified state in the gaps 66. In other words, it is desirable that the capacity of the cold head insertion unit 18 be set on the basis of a required volume of the heat conduction medium for filling the gaps 66 with the heat conduction medium in the liquid state and a density ratio of the heat conduction medium (ratio of the density in the liquid state with respect to the density in the gas state at one atmosphere and at 0° C.) as indicated in Table 1 below.

TABLE 1

| | TYPE OF GAS | | | |
|---|---|---|---|---|
| | $^4He$ | $H_2$ | Ne | $N_2$ |
| LIQUID DENSITY AT BOILING POINT [g/cc] | 0.125 | 0.071 | 1.205 | 0.808 |
| GAS DENSITY [g/L] AT 1 ATMOSPHERE AND 0° C. | 0.1785 | 0.0899 | 0.901 | 1.250 |
| DENSITY RATIO | 700 | 790 | 1337 | 646 |

The present invention is not limited to the above-described embodiment. For example, the following embodiments are possible.

Although, in the embodiment, the heat switch 70 is turned on and off by displacing the base part 34 of the cold head insertion unit 18, the heat switch 70 may be turned on and off by displacing the refrigeration-object-side heat switch element (refrigeration-object-side metallic plate 74 in FIG. 3). However, here, in contrast to the case in which special means is required for operating the refrigeration-object-side heat switch element, the case that is based on the displacement of the base part 34 of the cold head insertion unit 18 as in the above-described embodiment has the advantage that the heat switch 70 can be turned on and off by making use of the inserting operation force of the cold head 26. When the base part 34 is displaced by making use of the inserting operation force of the cold head 26 as mentioned above, operation force transmitting units for transmitting the inserting operation force may be provided separately from the positioning units 67 and 68.

The refrigeration-device-side recesses and protrusions and the insertion-unit-side recesses and protrusions according to the present invention are not limited to those that include the fins 62 and 64 mentioned above. For example, the refrigeration-device-side recesses and protrusions may include a plurality of refrigeration-device-side projections that project in a rod form or a spherical form towards the insertion-unit-side protrusions and recesses; and the insertion-unit-side recesses and protrusions may include similar rod-shaped or spherical projections that project between the corresponding refrigeration-device-side projections.

The refrigeration-device-side positioning unit and the insertion-unit-side positioning unit according to the present invention may be positioned away from the thermal coupling formation part. For example, they may be provided at an intermediate portion of the cold head or an inlet-side of the cold head insertion unit. However, the positioning units that are disposed side by side with the refrigeration-device-side recesses and protrusions and the insertion-unit-side recesses and protrusions are capable of being used for prescribing the sizes of the gaps between the refrigeration-device-side recesses and protrusions and the insertion-unit-side recesses and protrusions with high precision.

The temperature controlling device 80 can be omitted. For example, when the heat conduction medium has a large temperature region in which the liquid phase is maintained, merely refrigerating the heat conduction medium at a low speed can cause the heat conduction medium to be brought into the liquid phase during the refrigeration thereof and cause it to reach all parts of the gaps between the refrigeration-device-side recesses and protrusions and the insertion-unit-side recesses and protrusions. When the density of the heat conduction medium is sufficiently higher than the density of air, gas in the cold head insertion unit may be replaced by the heat conduction medium before the cold head is inserted into the cold head insertion unit. In other words, the cold head may be inserted into the cold head insertion unit after replacing the gas.

As mentioned above, the present invention provides an ultra-low-temperature device that is used for refrigerating an object to be refrigerated by using a refrigeration device including a cold head and that enables the cold head to be coupled in a detachable manner so as to allow highly efficient heat transfer with respect to the object to be refrigerated while effectively suppressing the infiltration of heat into the object to be refrigerated; and a method for refrigerating an object to be refrigerated by using the ultra-low-temperature device.

The ultra-low-temperature device includes a refrigeration-object container that includes an outside wall, the refrigeration-object container being provided for containing the object to be refrigerated at an inner side of the refrigeration-object container; a cold head insertion unit that extends from the outside wall towards the object to be refrigerated, the cold head insertion unit including a cylindrical part and a base part, the cylindrical part opening to an outside of the outside wall so as to allow the cold head to be inserted from a side of a low-temperature end of the cold head, the base part being coupled to the cylindrical part so as to cover a far-side end portion of the cylindrical part, the cold head insertion unit having a shape that allows an internal portion of the cold head insertion unit to be hermetically sealed by the inserted cold head; a thermal coupling formation part for forming a thermal coupling part between the low-temperature end of the cold head and the base part of the cold head insertion unit so as to allow conduction of heat therebetween; and a heat switch that is provided between the base part of the cold head insertion unit and the object to be refrigerated. The thermal coupling formation part includes refrigeration-device-side recesses and protrusions and insertion-unit-side recesses and protrusions, the refrigeration-device-side recesses and protrusions being provided at the low-temperature end of the cold head and rising and falling in a direction that is parallel to a direction of insertion of the cold head, the insertion-unit-side recesses and protrusions being provided at a surface of the base part of the cold head insertion unit that faces the side of the low-temperature end of the cold head and rising and falling in the direction that is parallel to the direction of insertion of the cold head so as to be capable of opposing the refrigeration-device-side recesses and protrusions at a gap. The refrigeration-device-side recesses and protrusions and the insertion-unit-side recesses and protrusions having a form that forms the thermal coupling part by solidifying a heat conduction medium in a gaseous state at an operation temperature of the low-temperature end of the cold head in the gap between the refrigeration-device-side recesses and protrusions and the insertion-unit-side recesses and protrusions. The heat switch includes an insertion-unit-side heat switch element and a refrigeration-object-side heat switch element, the insertion-unit-side heat switch element being provided at a refrigeration-object-side surface of the base part, which is a surface of the base part that faces the object to be refrigerated, the refrigeration-object-side heat switch element being disposed at the object to be refrigerated so as to oppose the insertion-unit-side heat switch element in the direction that is parallel to the direction of insertion of the cold head. The heat switch is switched between an on state and an off state, the on state being a state in which the conduction of heat is allowed between the base part of the cold head insertion unit and the object to be refrigerated when the switch elements contact each other as a result of the switch elements being displaced relative to each other in the direction that is parallel to the direction of insertion of the cold head, the off state being a state in which the conduction of heat is blocked between the base part of the cold head insertion unit and the object to be refrigerated when the switch elements are separated from each other as a result of the switch elements being displaced relative to each other in the direction that is parallel to the direction of insertion of the cold head.

The present invention provides a method for refrigerating the object to be refrigerated by using the ultra-low-temperature device. The method includes providing the ultra-low-temperature device; inserting the cold head of the refrigeration device into the cold head insertion unit of the ultra-low-temperature device from the side of the low-temperature end of the cold head of the refrigeration device to hermetically seal an inside of the cold head insertion unit and to cause the refrigeration-device-side recesses and protrusions, provided at the low-temperature end of the cold head, and the insertion-unit-side recesses and protrusions to oppose each other at the gap; forming the thermal coupling part by solidifying the heat conduction medium in the gaseous state in the gap by operating the refrigeration device; and turning on the heat switch.

Accordingly, the thermal coupling part that is formed of the solidified heat conduction medium, the refrigeration-device-side recesses and protrusions, and the insertion-unit-side recesses and protrusions allows cold of the refrigeration device to be transferred from the low-temperature end thereof to the base part of the cold head insertion unit via the thermal coupling part. The cold that has been transferred to the base part can be transferred to the object to be refrigerated via the heat switch in the on state (that is, via the insertion-unit-side heat switch element and the refrigeration-object-side heat switch element that are in contact with each other).

Further, the cold head inserted into the cold head insertion unit in this way can be detached from the cold head insertion unit while suppressing the infiltration of heat into the object to be refrigerated. More specifically, with the heat switch being set in the off state (that is, with the insertion-unit-side heat switch element and the refrigeration-object-side heat switch element being separated from each other), the operation of the refrigeration device may be stopped. By this, the temperature of the thermal coupling part formed of the solidified heat conduction medium rises and the thermal coupling part is evaporated, as a result of which the refrigeration end of the cold head and the base part of the cold head insertion unit that have been coupled up until now are separable. At this time, since the heat switch is set in the off state, the infiltration of heat into the object to be refrigerated caused by the rise in temperature is effectively suppressed.

More specifically, as means for turning on and off the heat switch, it is desirable that the cylindrical part of the cold head insertion unit be stretchable and contractible in the direction that is parallel to the direction of insertion of the cold head, the insertion-unit-side heat switch element be caused to separate from the refrigeration-object-side heat switch element when the cylindrical part is in a contracted state, and the insertion unit-side heat switch element be caused to contact the refrigeration-object-side heat switch element when the cylindrical part is in a stretched state. According to this structure, it is possible to switch between the on and off state of the heat switch by stretching and contracting the cylindrical part of the cold head insertion unit without using a complicated structure at the refrigeration-object side.

Further, it is desirable that the cylindrical part be resiliently stretchable and contractible in the direction of insertion of the cold head and, when the cold head is not inserted, the cylindrical part have a natural length that causes the insertion-unit-side heat switch element to be separated from the refrigeration-object-side heat switch element; and that the ultra-low-temperature device include operation force transmitting units that are provided at the respective cold head and cold head insertion unit, and that contact each other in the direction that is parallel to the direction of insertion of the cold head when the cold head is inserted, the operation force transmitting units transmitting an operation force that acts in the insertion direction and that is applied to the cold head to the cold head insertion unit and causing the cylindrical part of the cold head insertion unit to be stretched, so that the insertion-unit-side heat switch element contacts the refrigeration-object-side heat switch element. In this structure, it is possible to make use of the inserting of the cold head into the cold head insertion unit and switch the heat switch from off to on.

In addition, it is desirable that the operation force transmitting units be disposed such that when the operation force transmitting units contact each other, the gap is provided between the refrigeration-device-side recesses and protrusions and the insertion-unit-side recesses and protrusions.

It is desirable that the refrigeration-object-side heat switch element be supported by the object to be refrigerated with a supporting member including a resiliently deformable braid being disposed therebetween, and the braid allow the refrigeration-object-side heat switch element to be displaced towards the object to be refrigerated by resilient deformation of the braid. In this case, by inserting the cold head into the cold head insertion unit such that the base part is displaced until the braid is resiliently deformed, it is possible to increase the degree of contact between the heat switch elements by increasing contact pressure therebetween as a result of making use of the resilient force of the braid.

It is desirable that the refrigeration-device-side recesses and protrusions and the insertion-unit-side recesses and protrusions have a shape that allows the gap to be formed between the refrigeration-device-side recesses and protrusions and the insertion-unit-side recesses and protrusions in both the direction that is parallel to the insertion direction and in a radial direction of the cold head that is orthogonal to the parallel direction. Such a form allows, through the solidified heat conduction medium, cold to be transferred to locations between the refrigeration-device-side recesses and protrusions and the insertion-unit-side recesses and protrusions, not only in a direction that is parallel to the direction of insertion of the cold head, but also in the radial direction of the cold head. As a result, it is possible to further increase thermal conductivity.

More specifically; it is desirable that the refrigeration-device-side recesses and protrusions include a refrigeration-device-side base surface that opposes the insertion-unit-side recesses and protrusions and a plurality of refrigeration-device-side fins that protrude from the refrigeration-device-side base surface, and the insertion-unit-side recesses and protrusions include an insertion-unit-side base surface that opposes the refrigeration-device-side recesses and protrusions and a plurality of insertion-unit-side fins that protrude from the insertion-unit-side base surface to a location or locations between the refrigeration-device-side fins.

In such cases, it is desirable that the ultra-low-temperature device further include positioning units that are provided at the respective cold head and cold head insertion unit, wherein, as a result of the positioning units coming into contact with each other when the cold head is inserted, the positioning units position the refrigeration-device-side recesses and protrusions and the insertion-unit-side recesses and protrusions relative to each other such that the gap is provided between the refrigeration-device-side recesses and protrusions and the insertion-unit-side recesses and protrusions in both the direction that is parallel to the insertion direction and in the radial direction of the cold head that is orthogonal to the parallel direction. The positioning units allow a suitable gap to be provided between the refrigeration-device-side recesses and protrusions and the insertion-unit-side recesses and protrusions in both the direction of insertion of the cold head and in the radial direction of the cold head by only inserting the cold head into the cold head insertion unit.

More specifically, in the ultra-low-temperature device, desirable that the positioning units include a refrigeration-device-side positioning unit and an insertion-unit-side positioning unit, the refrigeration-device-side positioning unit protruding, along with the refrigeration-device-side fins, from the low-temperature end of the cold head towards the base part of the cold head insertion unit, the insertion-unit-side positioning unit protruding, along with the insertion-unit-side fins, from the base part of the cold head insertion unit towards the low-temperature end of the cold head, wherein both of the positioning units have contact surfaces that contact each other, and wherein the contact surfaces are tapering surfaces that taper towards the base part of the cold head insertion unit as the contact surfaces extend towards an inner side in the radial direction of the cold head insertion unit. These contact surfaces allow positioning in both the direction of insertion of the cold head and the radial direction of the cold head to be performed at the same time when the contact surfaces cause the refrigeration-device-side positioning unit to move towards the inner side in the radial direction of the insertion-unit-side positioning unit.

It is desirable that the ultra-low-temperature device further include a sealing unit that is provided at the cold head, wherein, when the cold head is inserted into the cold head insertion unit, the sealing unit contacts the refrigeration-object container or the cold head insertion unit and hermetically seals an inside of the cold head insertion unit. In this case, it is desirable that the ultra-low-temperature device further include a gas supply and exhaust pipe for replacing gas in the cold head insertion unit hermetically sealed by the sealing unit by gas of the heat conduction medium.

It is desirable that ultra-low-temperature device further include a temperature controlling device that controls a temperature of the thermal coupling formation part to a temperature for maintaining the heat conduction medium in a liquid phase during operation of the cold head inserted in the cold head insertion unit. Control of temperature by using the temperature controlling device allows the heat conduction medium to reach all parts of the gap between the refrigeration-device-side recesses and protrusions and the insertion-unit-side recesses and protrusions by bringing the heat conduction medium supplied into the cold head insertion unit into a liquid phase once. Then, by stopping the temperature control and solidifying the heat conduction medium, the solidified heat conduction medium can be reliably provided in the gap.

The invention claimed is:

1. An ultra-low-temperature device for refrigerating an object to be refrigerated by using a refrigeration device including a cold head, the ultra-low-temperature device comprising:

a refrigeration-object container that includes an outside wall, the refrigeration-object container being provided for containing the object to be refrigerated at an inner side of the refrigeration-object container;

a cold head insertion unit that extends from the outside wall towards the object to be refrigerated, the cold head insertion unit including a cylindrical part and a base part, the cylindrical part opening to an outside of the outside wall so as to allow the cold head to be inserted from a side of a low-temperature end of the cold head, the base part being coupled to the cylindrical part so as to cover a far-side end portion of the cylindrical part, the cold head insertion unit having a shape that allows an internal portion of the cold head insertion unit to be hermetically sealed by inserting the cold head;

a thermal coupling formation part for forming a thermal coupling part between the low-temperature end of the cold head and the base part of the cold head insertion unit so as to allow conduction of heat therebetween; and a heat switch that is provided between the base part of the cold head insertion unit and the object to be refrigerated, wherein the thermal coupling formation part includes refrigeration-device-side recesses and protrusions and insertion-unit-side recesses and protrusions, the refrigeration-device-side recesses and protrusions being provided at the low-temperature end of the cold head and rising and falling in a direction that is parallel to a direction of insertion of the cold head, the insertion-unit-side recesses and protrusions being provided at a surface of the base part of the cold head insertion unit that faces the side of the low-temperature end of the cold head and rising and falling in the direction that is parallel to the direction of insertion of the cold head so as to be capable of opposing the refrigeration-device-side recesses and protrusions at a gap, the refrigeration-device-side recesses and protrusions and the insertion-unit-side recesses and protrusions having a form that forms the thermal coupling part by solidifying a heat conduction medium in a gaseous state at an operation temperature of the low-temperature end of the cold head in the gap between the refrigeration-device-side recesses and protrusions and the insertion-unit-side recesses and protrusions, and wherein the heat switch includes an insertion-unit-side heat switch element and a refrigeration-object-side heat switch element, the insertion-unit-side heat switch element being provided at a refrigeration-object-side surface of the base part, which is a surface of the base part that faces the object to be refrigerated, the refrigeration-object-side heat switch element being disposed at the object to be refrigerated so as to oppose the insertion-unit-side heat switch element in the direction that is parallel to the direction of insertion of the cold head, the heat switch being switched between an on state and an off state, the on state being a state in which the conduction of heat is allowed between the base part of the cold head insertion unit and the object to be refrigerated when the switch elements contact each other as a result of the switch elements being displaced relative to each other in the direction that is parallel to the direction of insertion of the cold head, the off state being a state in which the conduction of heat is blocked between the base part of the cold head insertion unit and the object to be refrigerated when the switch elements are separated from each other as a result of the switch elements being displaced relative to each other in the direction that is parallel to the direction of insertion of the cold head.

2. The ultra-low-temperature device according to claim 1, wherein the cylindrical part of the cold head insertion unit is stretchable and contractible in the direction that is parallel to the direction of insertion of the cold head, and wherein the insertion-unit-side heat switch element is caused to separate from the refrigeration-object-side heat switch element when the cylindrical part is in a contracted state, and the insertion-unit-side heat switch element is caused to contact the refrigeration-object-side heat switch element when the cylindrical part is in a stretched state.

3. The ultra-low-temperature device according to claim 2, wherein the cylindrical part is resiliently stretchable and contractible in the direction of insertion of the cold head and, when the cold head is not inserted, the cylindrical part has a natural length that causes the insertion-unit-side heat switch element to be separated from the refrigeration-object-side heat switch element, and wherein the ultra-low-temperature device includes operation force transmitting units that are provided at the respective cold head and cold head insertion unit, and that contact each other in the direction that is parallel to the direction of insertion of the cold head when the cold head is inserted, the operation force transmitting units transmitting an operation force that acts in the insertion direction and that is applied to the cold head to the cold head insertion unit and causing the cylindrical part of the cold head insertion unit to be stretched, so that the insertion-unit-side heat switch element contacts the refrigeration-object-side heat switch element.

4. The ultra-low-temperature device according to claim 3, wherein the operation force transmitting units are disposed such that, when the operation force transmitting units contact each other, the gap is provided between the refrigeration-device-side recesses and protrusions and the insertion-unit-side recesses and protrusions.

5. The ultra-low-temperature device according to claim 3, wherein the refrigeration-object-side heat switch element is supported by the object to be refrigerated with a supporting member including a resiliently deformable braid being disposed therebetween, and the braid allows the refrigeration-object-side heat switch element to be displaced towards the object to be refrigerated by resilient deformation of the braid.

6. The ultra-low-temperature device according to claim 1, wherein the refrigeration-device-side recesses and protrusions and the insertion-unit-side recesses and protrusions have a shape that allows the gap to be formed between the refrigeration-device-side recesses and protrusions and the insertion-unit-side recesses and protrusions in both the direction that is parallel to the insertion direction and in a radial direction of the cold head that is orthogonal to the parallel direction.

7. The ultra-low-temperature device according to claim 6, wherein the refrigeration-device-side recesses and protrusions include a refrigeration-device-side base surface that opposes the insertion-unit-side recesses and protrusions and a plurality of refrigeration-device-side fins that protrude from the refrigeration-device-side base surface, and wherein the insertion-unit-side recesses and protrusions include an insertion-unit-side base surface that opposes the refrigeration-device-side recesses and protrusions and a plurality of insertion-unit-side fins that protrude from the insertion-unit-side base surface to a location or locations between the refrigeration-device-side fins.

8. The ultra-low-temperature device according to claim 6, further comprising positioning units that are provided at the respective cold head and cold head insertion unit, wherein, as a result of the positioning units coming into contact with each other when the cold head is inserted, the positioning units position the refrigeration-device-side recesses and protrusions and the insertion-unit-side recesses and protrusions relative to each other such that the gap is provided between the refrigeration-device-side recesses and protrusions and the insertion-unit-side recesses and protrusions in both the direction that is parallel to the insertion direction and in the radial direction of the cold head that is orthogonal to the parallel direction.

9. The ultra-low-temperature device according to claim 8, wherein the positioning units include a refrigeration-device-side positioning unit and an insertion-unit-side positioning unit, the refrigeration-device-side positioning unit protruding, along with the refrigeration-device-side fins, from the low-temperature end of the cold head towards the base part of the cold head insertion unit, the insertion-unit-side positioning unit protruding, along with the insertion-unit-side fins, from the base part of the cold head insertion unit towards the low-temperature end of the cold head, wherein both of the positioning units have contact surfaces that contact each other, and wherein the contact surfaces are tapering surfaces that taper towards the base part of the cold head insertion unit as the contact surfaces extend towards an inner side in the radial direction of the cold head insertion unit.

10. The ultra-low-temperature device according to claim 1, further comprising a sealing unit that is provided at the cold head, wherein, when the cold head is inserted into the cold head insertion unit, the sealing unit contacts the refrigeration-object container or the cold head insertion unit and hermetically seals an inside of the cold head insertion unit.

11. The ultra-low-temperature device according to claim 10, further comprising a gas supply and exhaust pipe for replacing gas in the cold head insertion unit hermetically sealed by the sealing unit by gas of the heat conduction medium.

12. The ultra-low-temperature device according to claim 1, further comprising a temperature controlling device that controls a temperature of the thermal coupling formation part to a temperature for maintaining the heat conduction medium in a liquid phase during operation of the cold head inserted in the cold head insertion unit.

13. A method for refrigerating an object to be refrigerated by using a refrigeration device including a cold head, the method comprising:

providing the ultra-low-temperature device according to claim 1;

inserting the cold head of the refrigeration device into the cold head insertion unit of the ultra-low-temperature device from the side of the low-temperature end of the cold head of the refrigeration device to hermetically seal an inside of the cold head insertion unit and to cause the refrigeration-device-side recesses and protrusions, provided at the low-temperature end of the cold head, and the insertion-unit-side recesses and protrusions to oppose each other at the gap;

forming the thermal coupling part by solidifying the heat conduction medium in the gaseous state in the gap by operating the refrigeration device; and turning on the heat switch.

14. The method for refrigerating an object to be refrigerated according to claim 13, comprising:

prior to solidifying the heat conduction medium in the gaseous state in the gap by operating the refrigeration device, controlling a temperature of the thermal coupling formation part such that the heat conduction medium is brought into a liquid phase once and the heat conduction medium reaches all parts of the gap between the refrigeration-device-side recesses and protrusions and the insertion-unit-side recesses and protrusions of the thermal coupling formation part.

* * * * *